US008628035B2

(12) United States Patent
Ramun

(10) Patent No.: US 8,628,035 B2
(45) Date of Patent: Jan. 14, 2014

(54) BLADE SET FOR JAWS USED IN RAIL BREAKING DEMOLITION EQUIPMENT

(76) Inventor: John R. Ramun, Poland, OH (US)

( * ) Notice: Subject to any disclaimer, the term of this patent is extended or adjusted under 35 U.S.C. 154(b) by 32 days.

(21) Appl. No.: 13/387,806

(22) PCT Filed: Aug. 9, 2010

(86) PCT No.: PCT/US2010/044895

§ 371 (c)(1),
(2), (4) Date: Feb. 29, 2012

(87) PCT Pub. No.: WO2011/017703

PCT Pub. Date: Feb. 10, 2011

(65) Prior Publication Data

US 2012/0168543 A1 Jul. 5, 2012

Related U.S. Application Data

(63) Continuation-in-part of application No. 12/537,567, filed on Aug. 7, 2009, now Pat. No. 8,231,071.

(51) Int. Cl.

| | |
|---|---|
| ***A01D 34/00*** | (2006.01) |
| ***B02B 5/00*** | (2006.01) |
| ***B02C 9/04*** | (2006.01) |

(52) U.S. Cl.
USPC ..... 241/101.73; 30/134; 241/266; 241/300

(58) Field of Classification Search
USPC ..... 30/134; 241/101.73, 266, 300
See application file for complete search history.

(56) References Cited

U.S. PATENT DOCUMENTS

| | | | | |
|---|---|---|---|---|
| 4,519,135 | A | 5/1985 | LaBounty | |
| 4,571,968 | A * | 2/1986 | Kanno et al. | 72/331 |
| 4,670,983 | A | 6/1987 | Ramun et al. | |
| 4,776,524 | A * | 10/1988 | Sakato | 241/101.73 |
| 4,838,493 | A * | 6/1989 | LaBounty | 241/101.73 |
| 4,890,798 | A * | 1/1990 | Tagawa et al. | 241/266 |
| 4,951,886 | A * | 8/1990 | Berto | 241/101.73 |
| 5,044,569 | A * | 9/1991 | LaBounty et al. | 241/266 |
| 5,060,378 | A | 10/1991 | LaBounty et al. | |
| 5,301,882 | A | 4/1994 | Morikawa et al. | |
| 5,361,999 | A | 11/1994 | Sakato et al. | |

(Continued)

FOREIGN PATENT DOCUMENTS

| | | | |
|---|---|---|---|
| DE | 4417832 | A1 | 11/1994 |
| EP | 0384872 | A1 | 8/1990 |

(Continued)

*Primary Examiner* — Dana Ross
*Assistant Examiner* — Onekki Jolly
(74) *Attorney, Agent, or Firm* — The Webb Law Firm

(57) ABSTRACT

A blade set associated with jaws for demolition equipment used to break railroad rails includes a bottom blade associated with a bottom jaw and a top blade associated with a top jaw, wherein the bottom jaw and the top jaw are rotatable relative to one another. The bottom blade includes two spaced-apart support rails separated by a cavity, while the top blade includes a single raised knife rail positioned and central to the cavity and rotatable toward the cavity. The top blade additionally may be marked with indicia, such as red paint, such that the machine operator may properly orient the top blade during a cutting operation to maximize safety. Additionally, the recesses may also be aligned and sized to engage the head and the foot of a rail such that tension and/or a bending moment is introduced between the head and foot of the rail.

17 Claims, 14 Drawing Sheets

(56) References Cited

U.S. PATENT DOCUMENTS

| | | | | |
|---|---|---|---|---|
| 5,474,242 | A | 12/1995 | Rafn | |
| RE35,432 | E | 1/1997 | LaBounty et al. | |
| 5,822,893 | A | 10/1998 | Ostermeyer | |
| 5,926,958 | A | 7/1999 | Ramun | |
| 5,940,971 | A | 8/1999 | Ramun | |
| 6,061,911 | A | 5/2000 | LaBounty et al. | |
| 6,202,308 | B1 | 3/2001 | Ramun | |
| 6,926,217 | B1 | 8/2005 | LaBounty et al. | |
| 7,025,240 | B2 * | 4/2006 | Purser | 225/103 |
| 7,284,718 | B2 | 10/2007 | Christenson | |
| 7,354,010 | B2 * | 4/2008 | Ramun et al. | 241/101.73 |
| 2003/0132327 | A1 | 7/2003 | Muri | |
| 2006/0131454 | A1 | 6/2006 | Ramun et al. | |
| 2007/0001041 | A1 * | 1/2007 | Christenson | 241/101.73 |
| 2007/0245568 | A1 | 10/2007 | Schipp et al. | |

FOREIGN PATENT DOCUMENTS

| | | | |
|---|---|---|---|
| EP | 0384872 | A1 * | 8/1990 |
| JP | 58128258 | U | 8/1983 |
| JP | 63111550 | U | 7/1988 |
| JP | 4183516 | A | 6/1992 |
| JP | 2004176536 | A | 6/2004 |
| WO | 0128687 | A1 | 4/2001 |
| WO | 0168992 | A1 | 9/2001 |
| WO | 2004044349 | A2 | 5/2004 |

* cited by examiner

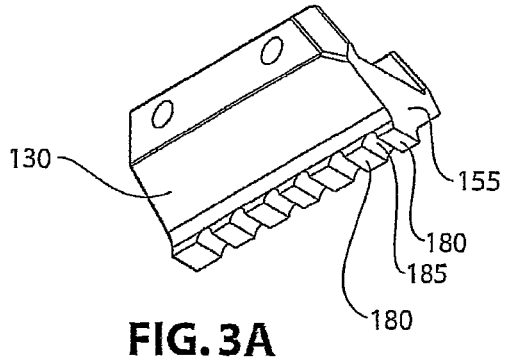
FIG. 3A
FIG. 3
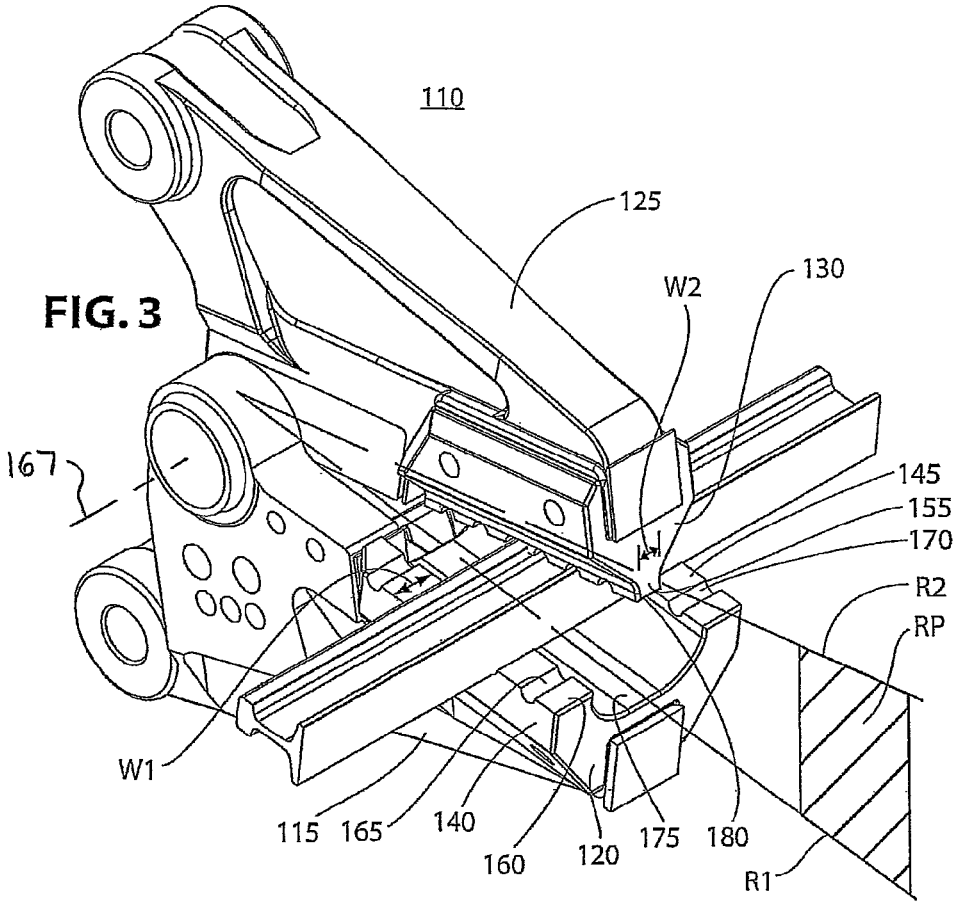

BLADE SET FOR JAWS USED IN RAIL BREAKING DEMOLITION EQUIPMENT

BACKGROUND OF THE INVENTION

1. Field of the Invention

The present invention relates to a blade set for jaws used in demolition, railroad rail breaking and railroad rail recycling equipment. More particularly, the present invention relates to an opposing blade set having planar rails with recesses extending thereacross and a tapered knife blade adapted in conjunction with an anvil blade to secure a portion of the rail after it is severed.

2. Description of Related Art

While the present invention relates to demolition and recycling equipment, this equipment is also referred to as construction equipment and scrap handling/processing equipment. The description of demolition equipment, recycling equipment, scrap handling equipment, or construction equipment is not intended to be restrictive to the equipment being referenced. Demolition and recycling equipment, such as heavy duty metal cutting shears, grapples, concrete crushers and rail breakers has been mounted on backhoes powdered by hydraulic cylinders for a variety of jobs in demolition and recycling industries.

In the dismantling of an industrial site, railroad rails are often salvaged and it is necessary for efficient handling and transportation of these rails to reduce their length. Rail reduction methods are used to break rail to desirable pre-determined sizes for this purpose. Railroad rails present a unique challenge because the rail is hardened and very rigid. As a result, hardened rails are not amenable to processing using a shear and, therefore, a rail breaker, which bends and breaks the rail, is the most efficient tool for severing these rails.

FIG. 1 is prior art, extracted from U.S. Pat. No. 7,354,010, the disclosure of which is hereby incorporated by reference. FIG. 1 illustrates a jaw set 10 having a bottom jaw 15 with a bottom blade 20 attached thereto and a top jaw 25 with a top blade 30 attached thereto forming a blade set 35. The bottom blade 20 (FIG. 2) includes two raised support rails 40, 45 with a cavity 50 therebetween, while the top jaw 25 includes a top blade 30 having a raised knife rail 55 centrally located above the cavity 50. The raised support rails 45, 50 and the knife rail 55 have generally planar surfaces along their lengths and, as a result, occasionally, the railroad rail slips from between the jaws 15, 25 prior to being severed. Additionally, the blades 20, 30 sever the railroad rail and both severed ends fall from the rail breaker so that when the process is continued, the rail breaker must reorient and grab the rail again prior to breaking it.

A design is needed to permit opposing jaws to more securely grab a railroad rail, making the breaking process more efficient.

SUMMARY OF THE INVENTION

One embodiment of the invention is directed to a blade set associated with jaws for demolition equipment, wherein at least one jaw rotates relative to the other jaw about a rotational axis within a rotational plane. The blade set has a bottom blade adapted to be secured to the bottom jaw. The bottom blade has a first radial axis therethrough and within the rotational plane and two raised support rails, each having planar surface segments generally perpendicular to the rotational plane and extending parallel to the first radial axis, recesses between the planar surface segments, wherein the recesses extend across the width of the support rail and the recesses of one support rail are aligned with corresponding recesses of the other rail, and a cavity extending between and adjacent to the support rails. A top blade adapted to be secured to the top jaw, a second radial axis therethrough and within the rotational plane, and a raised knife rail having planar surface segments generally perpendicular to the rotational plane and extending parallel to the second radial axis, and recesses between the planar surface segments, wherein the recesses extend across the width of the knife rail. The width of the knife rail at the planar surface segments is less than the width at the opening of the cavity. The top blade and the bottom blade are symmetric about the rotational plane. The recesses may also be aligned and sized to engage the head and the foot of a rail such that tension and/or a bending moment is introduced between the head and foot of the rail.

Another embodiment of the subject invention is directed to a jaw set with the blade set just described.

Yet another embodiment of the subject invention is directed to a method of processing a railroad rail using a rail breaker demolition tool having a jaw set with a bottom jaw with a bottom blade and a top jaw with a top blade. The blades have planar surfaces and recesses. The bottom blade has support rails with planar surfaces that are spaced apart by a cavity. The top blade has a knife rail with a planar surface, wherein the width of the knife rail increases linearly away from the planar surface. The method comprising the steps of a) holding the rail between the jaws such that the bottom blade provides spaced apart support to the rail, b) advancing the top jaw and bottom jaw together such that the top jaw applies a load on the rail midway between the spaced apart support of the bottom blade until the rail breaks and a severed portion is ejected from the jaws, and c) further advancing the jaws together until the wider portion of the knife rail compresses the remaining portion of the rail against the cavity walls to retain the remaining portion within the clamped jaw set. The method may also utilize recesses that are aligned and sized to engage the head and the foot of a rail such that tension and/or a bending moment is introduced between the head and foot of the rail.

BRIEF DESCRIPTION OF THE DRAWINGS

FIG. 3 is a perspective view of the jaw set in accordance with the subject invention;

FIG. 3A is a perspective view of the top blade in FIG. 3, but rotated to show features of the raised knife rail;

DESCRIPTION OF THE PREFERRED EMBODIMENTS

Figure 1:
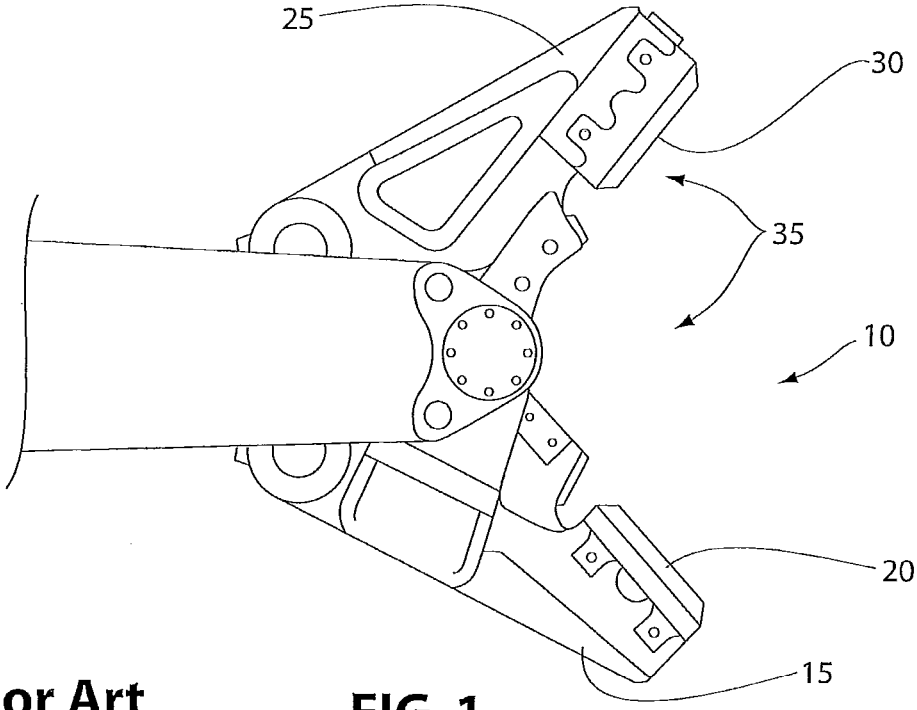
Prior Art FIG. 1
FIG. 1 is prior art and is a side view of a jaw set.

FIG. 3 illustrates a perspective view of a jaw set 110 for demolition equipment having a bottom jaw 115 pivotally connected to a top jaw 125. A bottom blade 120 is secured to the bottom jaw 115. The bottom blade 120 has a first radial axis R1 therethrough, wherein the first radial axis R1 is within a rotational plane RP of the jaws 115, 125. The bottom blade 120 has two raised support rails 140, 145. Each raised support rail 140, 145, as explained with respect to support rail 140, includes planar surface segments 160 (see also FIG. 4), wherein the planar surface segments 160 are generally perpendicular to the rotational plane RP and extend along the bottom blade 120 parallel to the first radial axis R1 (FIG. 3). Each support rail 140, 145, as illustrated in support rail 140, has recesses 165 between the planar surface segments 160. The recesses 165 extend across the width W1 of the raised support rail 145. The recesses 165 of one support rail 140 are aligned with the corresponding recesses 170 of the other raised support rail 145. A cavity 175 extends between and adjacent to the raised support rails 140, 145.

Relative pivotal motion between the bottom jaw 115 and the top jaw 125 is achieved when both jaws 115, 125 rotatably move about a rotational axis 167 or when one jaw is stationary and the other jaw rotates relative to the stationary jaw. As an example, bottom jaw 115 may be stationary and top jaw 125 may rotate.

A top blade 130 is secured to the top jaw 125. The top blade 130 has a second radial axis R2 running therethrough and within the rotational plane RP. The top blade 130 additionally includes a raised knife rail 155 having planar surface segments 180 (FIG. 3*a*) generally perpendicular to the rotational plane RP (FIG. 3) and extending parallel to the second radial axis R2. The raised knife rail 155 further includes recesses 185 between the planar surface segments 180, wherein the recesses 185 extend across the width W2 of the knife rail 155. Directing attention to FIG. 5, the width W2 of the knife rail at the planar surface segment 160 is less than the overall width W3 of the cavity 175.

The top blade 130 and the bottom blade 120 are symmetric about the rotational plane RP (FIG. 5) and the raised knife rail 155 closes into the cavity 175.

Figure 5:
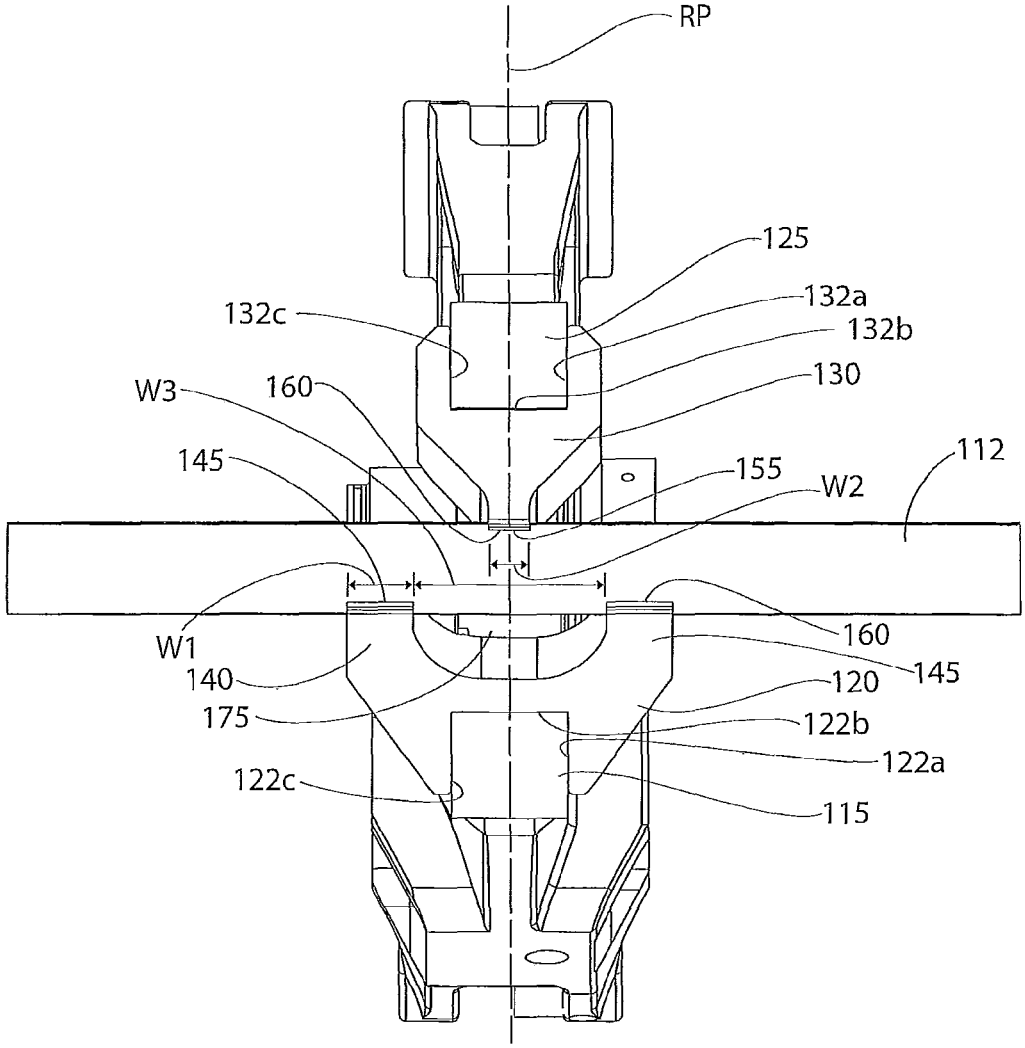
FIG. 5 is an end view of the jaw set illustrated in FIG. 3.

As illustrated in FIGS. 3 and 5, the bottom blade 120 and the top blade 130 are U-shaped to provide overlapping matching surfaces on the respective bottom jaw 115 and top jaw 125, such that the bottom blade and the top blade are supported by the jaws 115, 125 on three sides. For example, directing attention to FIG. 5, the bottom blade 120 is supported by the bottom jaw 115 along support surfaces 122*a*, 122*b*, and 122*c*. Additionally, the top blade 130 is supported by the top jaw 125 along three support surfaces 132*a*, 132*b*, and 132*c*.

Figure 6:
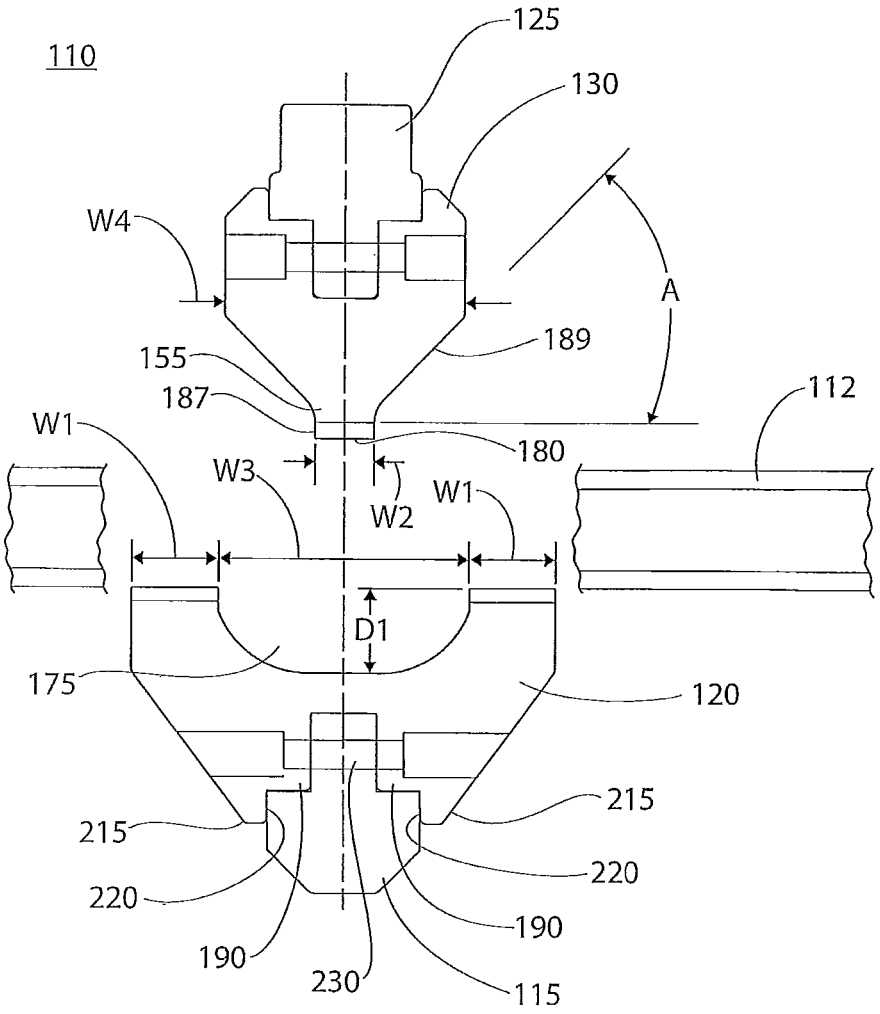
FIG. 6 is an end view of the jaw set illustrated in FIG. 5 with the railroad rail illustrated in broken cross-section and with the connections between the blades and the jaws shown.

Directing attention to FIG. 6, the width W2 of the knife rail 155 at the planar surface 180 is between 10-40% of the width W3 of the cavity 175 and preferably, the width W2 at the planar surface 180 of the knife rail 155 is approximately 20% of the width W3 of the cavity 175.

Figure 7A:
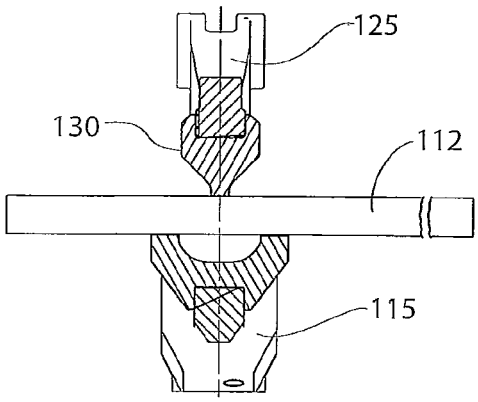
FIGS. 7A-7D illustrate the sequence of the rail breaker as it severs a railroad rail.
Figure 7B:
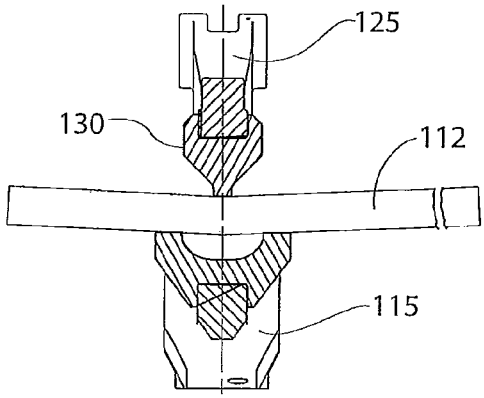
Figure 7C:
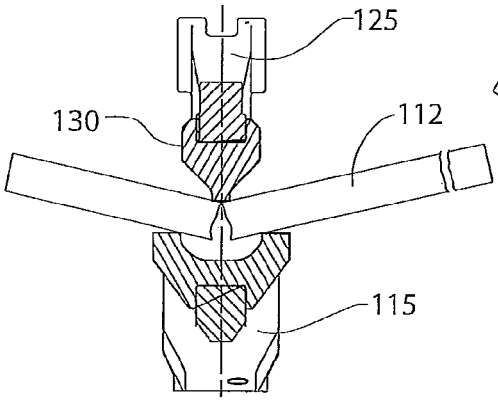

In addition to effectively breaking railroad rails, the subject jaw set 110 may also be used to hold one side of a railroad rail after it has been severed. In particular, FIGS. 7A-7D show the progression of severing a railroad rail 112 into two parts 112*a*, 112*b*. In FIG. 7A, the rail 112 is placed between the bottom jaw 115 and the top jaw 125. As illustrated in FIG. 7B, the bottom jaw 115 and the top jaw 125 are urged toward each other at which time the rail 112 begins to deflect. As previously mentioned, the material used for the rail is relatively brittle and, as a result, the rail 112 will deflect only a small degree before the rail breaks as illustrated in FIG. 7C.

Briefly returning to FIGS. 5 and 6, the rail 112 is supported by raised rail support 140 and raised rail support 145 and is unsupported along the width W3 of the cavity 175. The top jaw 125 applies a load to the rail 112 approximately midway between the width W3 of the cavity 175 to produce maximum stresses on the rail 112. It should be appreciated that the width W3 of the cavity 175 is made possible because the bottom blade 120 is wider than the bottom jaw 115 supporting it. This is achieved by the U-shaped connections between the bottom blade 120 and the bottom jaw 115.

Figure 7D:
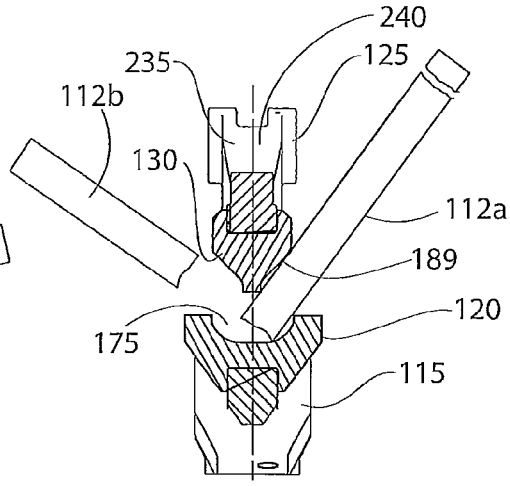

Returning to FIG. 7C, with a sufficient force supplied by the top jaw 125 against the rail 112, the rail breaks into two parts 112*a*, 112*b*, as illustrated in FIG. 7D. However, in the instances where the rail 112 is relatively long, then it is possible to configure the top blade 130 and the cavity 175, such that after the rail 112 is severed, the longer remaining half 112*a* may essentially be clamped between the top blade 130 and the bottom blade 120 so that the remaining rail section 112*a* may be positioned for an additional cut, or in the alternative, may be transported to a different location. In particular and directing attention to FIG. 6, the width W2 of the knife rail 155 extending away from the planar surface 180 remains generally constant in the region 187, however, thereafter, the width increases, as illustrated by the width in region 189 adjacent to region 187. Furthermore, the width in the region 189 may increase linearly and may increase to the width W4 equal to the width W3 of the cavity 175.

The knife rail 155 in the region 189 as it increases linearly forms an angle A with a line perpendicular to the rotational plane RP of between 30-60 degrees and preferably 45 degrees. Additionally, the cavity 175 may have a depth D1 of approximately 50-150% of the width W2 of the knife rail 155 at the planar surface segment 180. The cavity 175 may have a shape that is generally oval, however, regardless of the shape, it is important that the surfaces of the cavity 175 are continuous and do not intersect with sharp corners that produce high stress concentrations.

Figure 4:
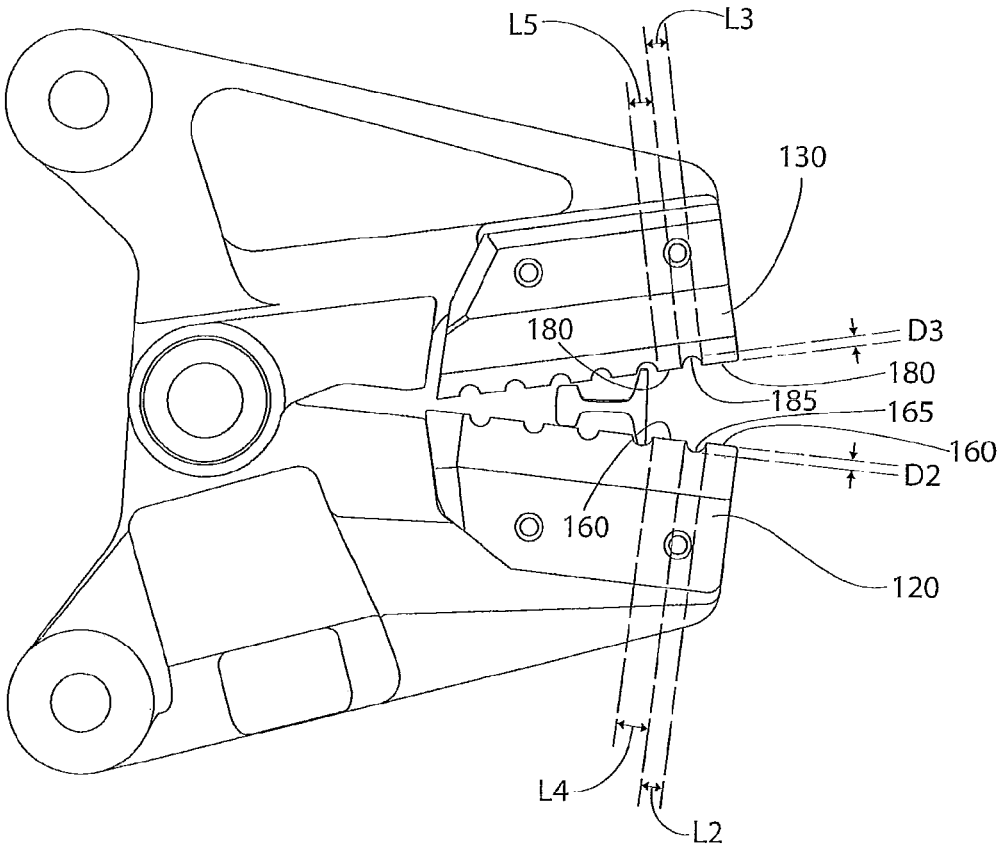
FIG. 4 is a side view of the jaw set illustrated in FIG. 3.

Directing attention to FIG. 4, each recess 165 associated with the bottom blade 120 has a depth D2 that is approximately 20-70% of the width W1 (FIG. 5) of the rail support 145. Additionally, the length L2 of the recess 165 is approximately 20-70% of the width W1 of the support rail 140. It is important to note that the length L4 of the planar recess segments 160 may be greater than the length L2 of the recesses 165. The purpose of this is to maximize the wear capacity of the bottom blade 120.

In a similar fashion, with respect to the top blade 130, each recess 185 has a depth D3 and the depth D3 is approximately 20-70% of the width W3 (FIG. 5) of the planar surface segment 160 of the knife rail 155. Furthermore, the length L3 of each recess is approximately 20-70% of the width W3 at the planar surface segment 160 of the knife rail 155. Finally, the length L5 of the planar surface segments 180 of the top blade 130 may be greater than the length L3 of the recesses 185 of the top blade 130. Once again, the purpose of this is to increase the longevity of the wear surfaces.

Again directing attention to FIG. 4, although in each instance the recesses 165, 185 of the bottom rail 120 and the top rail 135 are radiused, they may have different shapes, however, any intersection of surfaces should have radiused corners to minimize stress concentration factors. As illustrated in FIG. 4, both the bottom rail and the top rail have recesses 165, 185 that are generally arcuate in shape.

Figure 8:
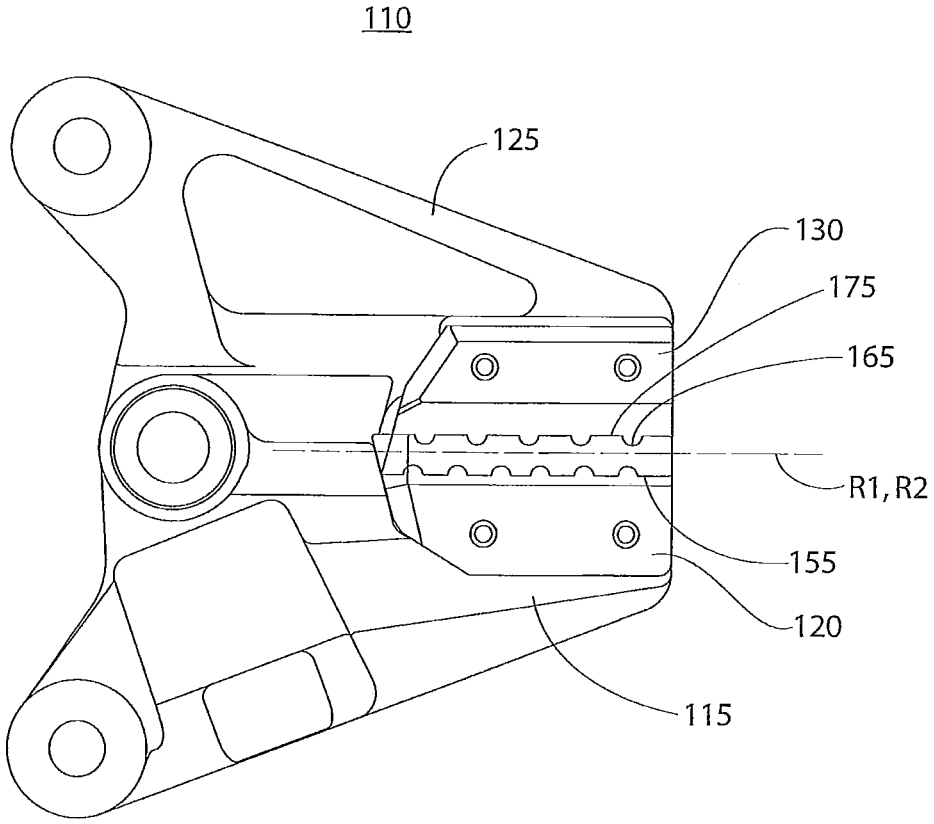
FIG. 8 is a side view of the jaw set in the closed position illustrating the relative position of the recesses between the jaws.

FIG. 8 illustrates a jaw set 110 with a bottom jaw 115 and a top jaw 125 in a closed position, such that the cavity 175 of the bottom blade 120 receives the radial knife rail 155. It should be noted, however, that the recesses 165 of the bottom blade 120 are, for the most part, shifted along the radial axis R1 relative to the recesses 185 of the top blade 130 with respect to the radial axis R2. Under certain circumstances, this off-set feature may enhance the ability of the bottom blade 120 and top blade 130 to hold and secure railroad rails.

FIG. 4 and FIG. 8 also illustrate the relative position of the bottom blade 120 and the top blade 130 in the partially opened position (FIG. 4) and in the completely closed position (FIG. 8). Although the rail to be broken is brittle, depending upon the size of the rail 112, the range of travel of the blades 120, 130 toward one another may be more or less. To break the rail 112, it must be sufficiently deflected to produce the stresses which cause failure and breakage. In certain instances, the rail 112 may be small and oriented such that the blades 120, 130 are nearly closed when the rail 112 is initially grabbed by the blades 120, 130. Under these circumstances, the travel of the blades 120, 130 is such that they overlap, as shown in FIG. 8. In particular, the travel of the blades 120, 130 may be so great in the closed position that the raised knife rail 155 enters the cavity 175 of the bottom blade 120. With this arrangement, the raised knife rail 155 may compress a rail 112 within the cavity 175.

Figure 9:
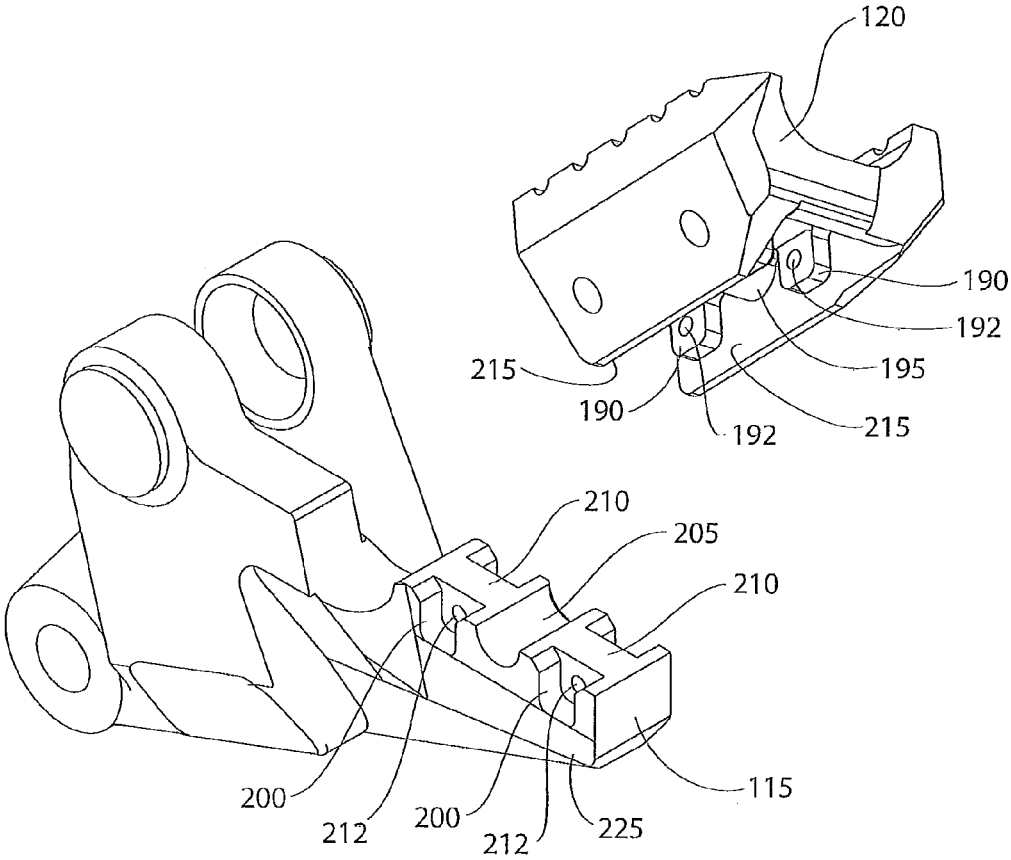
FIG. 9 is a perspective view of the bottom jaw illustrating the manner by which a bottom blade is retained.

Directing attention to FIGS. 3 and 9, the bottom blade 120 is removably secured to the bottom jaw 115 and the top blade 130 is removably attached to the top jaw 125. The arrangement for attaching each of these blades to its respective jaw is similar and, for that reason, the attachment of the bottom blade 120 to the bottom jaw 115 will be discussed with attention directed to FIGS. 6 and 9.

The bottom blade 120 includes holding lugs 190 and a stabilizer 195 protruding from the bottom blade 120. Extending through the holding lugs 190 are bores 192 adapted to accept bolts 230. The bottom jaw 115 has receivers 200 to accept the holding lugs 190 and a cradle 205 to accept the stabilizer 195. The holding lugs 190 extend on both sides of stiffening bars 210 extending along the lower jaw 115. The stiffening bars also have bores 212 aligned with bores 192 to accept bolts 230. Additionally, as illustrated in FIG. 6, below the holding lugs 190 are stabilizer wings 215 having surfaces 220 which abut the lower jaw surfaces 225 (FIG. 9) to provide additional stiffness and to resist twisting between the bottom blade 120 and the bottom jaw 115 when forces are applied to the bottom blade 120. As illustrated in FIG. 6, bolts 230 pass through the holding lugs 190 and the stiffening bars 210 to secure the bottom blade 120 to the bottom jaw 115. It is possible to include sleeves around the bolts 230 for additional strength.

It should be appreciated that this arrangement just discussed, with respect to the bottom blade 120 and its attachment to the bottom jaw 115, is also applicable to the attachment of the top blade 130 to the top jaw 125.

As illustrated in FIGS. 7C and 7D, when the railroad rail 112 is sufficiently stressed, due to the brittle nature of the rail 112, it will bend only slightly before breaking. The energy released when the rail 112 breaks, typically manifests itself in energy transmitted to the severed parts. As shown in FIG. 7D, while segment 112*a* is retained by the jaws 115, 125, segment 112*b* becomes an airborne projectile moving in a direction away from the bottom jaw 115. For that reason, during this cutting operation, for safety, the bottom jaw 115 of the jaw set 110 must be closest to the operator, while the top jaw 125 must be furthest from the operator. To insure this, the exterior surface 235 of the top jaw 125 is marked with indicia 240 to assist the operator in the proper orientation of the jaw set 110 during operation. In one embodiment, the indicia 240 may be a highly visible paint covering a substantial portion of the top jaw 125, such that the highly visible paint and, therefore, the top jaw 125 should not be visible to the operator during a cutting operation. Preferably, the highly visible paint is red paint. As a result, so long as during the cutting operation the operator does not see the indicia on the top jaw 125, then there is assurance that the path of segment 112*b*, as it becomes a projectile, will be directed away from the operator.

A method of processing a railroad rail 112 using a rail breaker demolition tool having a jaw set 110 with a bottom jaw 115 having a bottom blade 120, and a top jaw 125 having a top blade 130, involves the steps as illustrated in FIGS. 7A-7D of holding the rail 112 between the bottom jaw 115 and the top jaw 125, such that the bottom blade 120 of the bottom jaw 115 provides spaced-apart support using the raised support rail 140 and raised support rail 145. As illustrated in FIG. 7B, the top jaw 125 and the bottom jaw 115 are advanced together, such that the top jaw 125 applies a load on the rail 112 midway between the spaced-apart support of the bottom blade 120 until the rail 112 breaks (FIG. 7C) and a severed portion 112*b* (FIG. 7D) is ejected from the jaws 115, 125. The jaws 115, 125 are further advanced together until the wider portion 189 of the top blade 130 compresses the remaining portion of the rail 112*a* against the walls of the cavity 175 to retain the remaining portion 112*a* within the clamped jaw set 110. Additionally, when the exterior surface 235 of the top jaw 125 is marked with indicia 240, the method of processing may further include the step of orienting the jaw set 110 such that the indicia 240 of the top jaw 125 is furthermost away from the machine operator, such that any severed part 112*b* may be expelled in a direction away from the operator.

What has so far been described is the application of the jaw set 110 to break railroad rails. While this is the primary application for this jaw set 110, it should be appreciated that the jaw set 110 may have other applications including, for example, compressing hollow pipe either before or after it is cut with a shear to minimize the volume the pipe occupies, thereby increasing the efficiency of stockpiling and transporting such parts.

Furthermore, it should be appreciated that while the bottom blade 120 has been described as removably attached to the bottom jaw 115 and the top blade 130 has been described as removably attached to the top jaw 125, each blade and its respective jaw may be formed as a unified integral part, such that the jaw and blade would be integral with one another.

Figure 10:
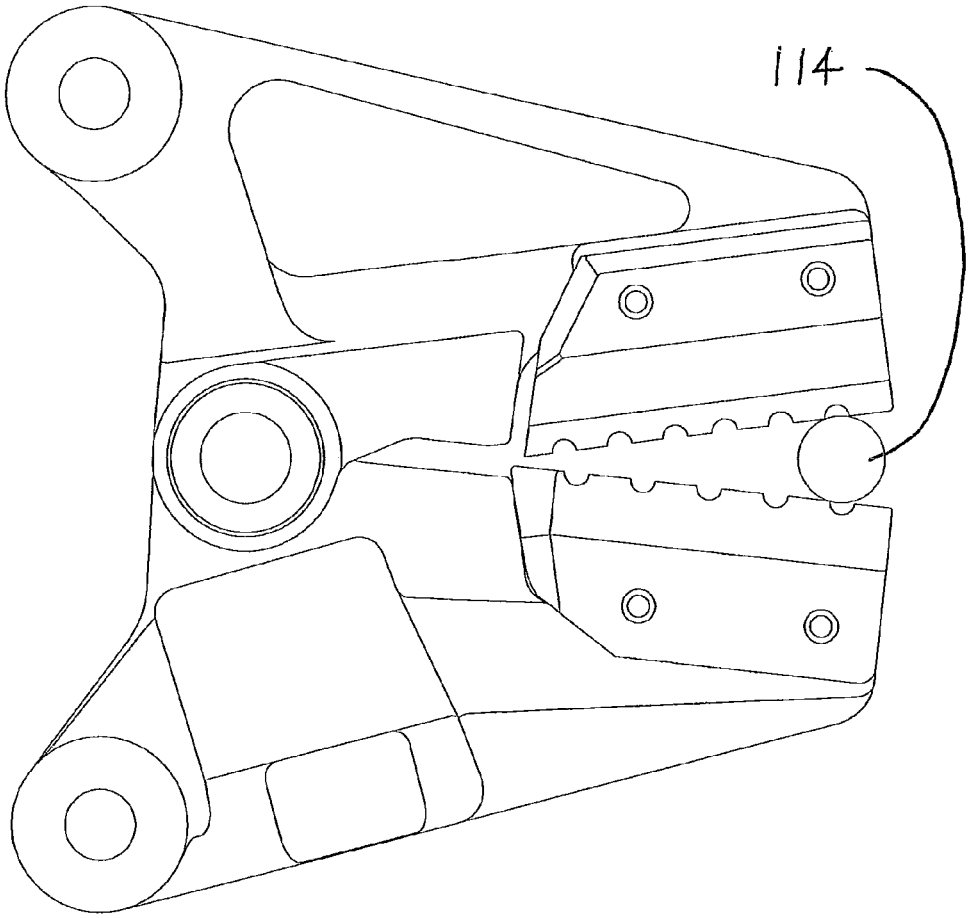
FIG. 10 is a side view similar to that illustrated in FIG. 4, however, showing a hardened round secured by the jaws.
Figure 11A:
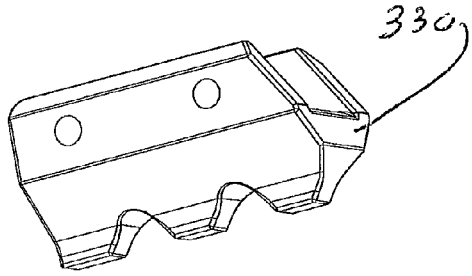
FIG. 11A is a perspective view of the top blade in FIG. 11, but rotated to show features of the raised knife rail.
Figure 11:
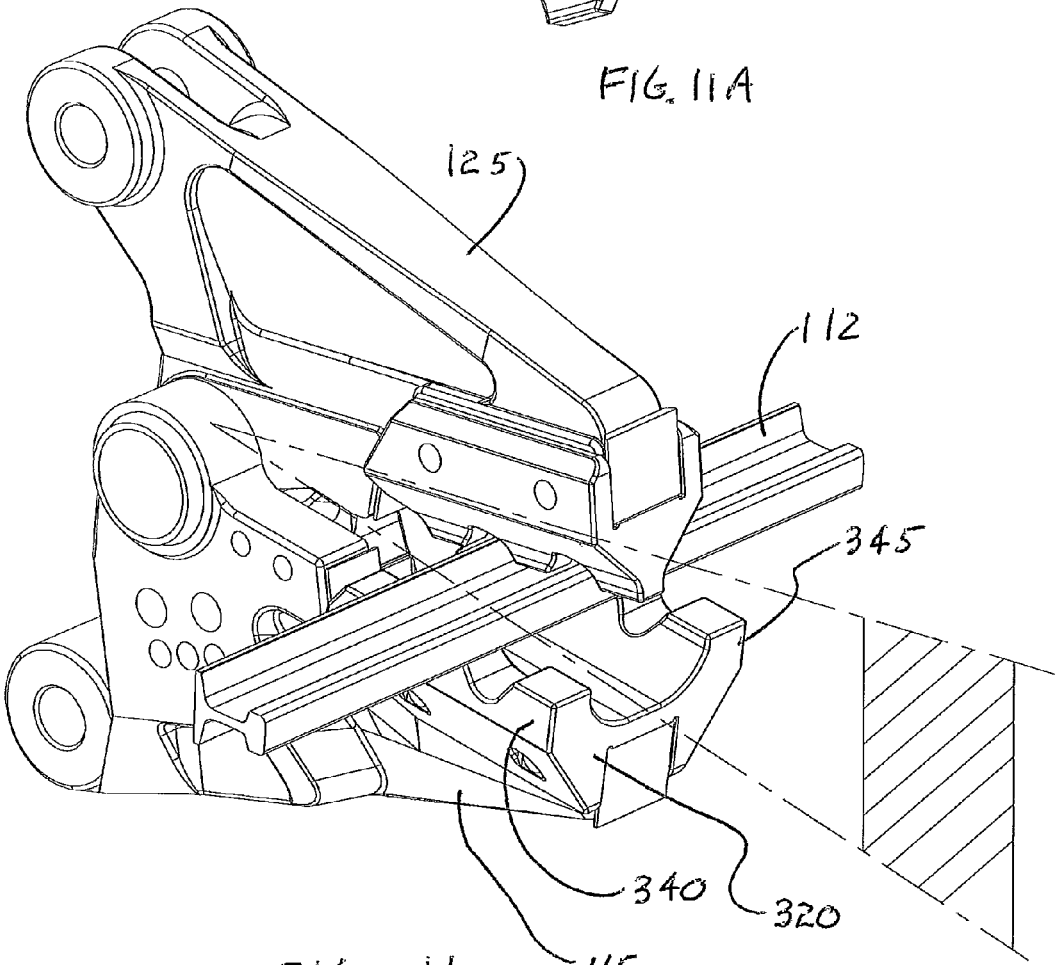
FIG. 11 is perspective view of the jaw set in accordance with a second embodiment of the subject invention.

While FIGS. 3-5 have illustrated the use of the jaw set 110 to retain a railroad rail 112, as illustrated in FIG. 10, this same jaw set may be used to secure and break a hardened round 114.

What has so far been described is a jaw set, as illustrated in FIG. 3, utilizing a bottom blade 120 and a top blade 130 having, as illustrated from the side view of FIG. 4, a bottom blade 120 and a top blade 130, wherein the bottom blade 120 having planar surface segments 160 with recesses 165 spaced therebetween, and with a top blade 130 having planar surface segments 180 with recesses 185 spaced therebetween. As further illustrated in FIG. 8, the recesses 165 of the bottom blade 120 and the recesses 185 (FIG. 4) of the top blade 130 are not aligned and are relatively shallow.

Figure 13:
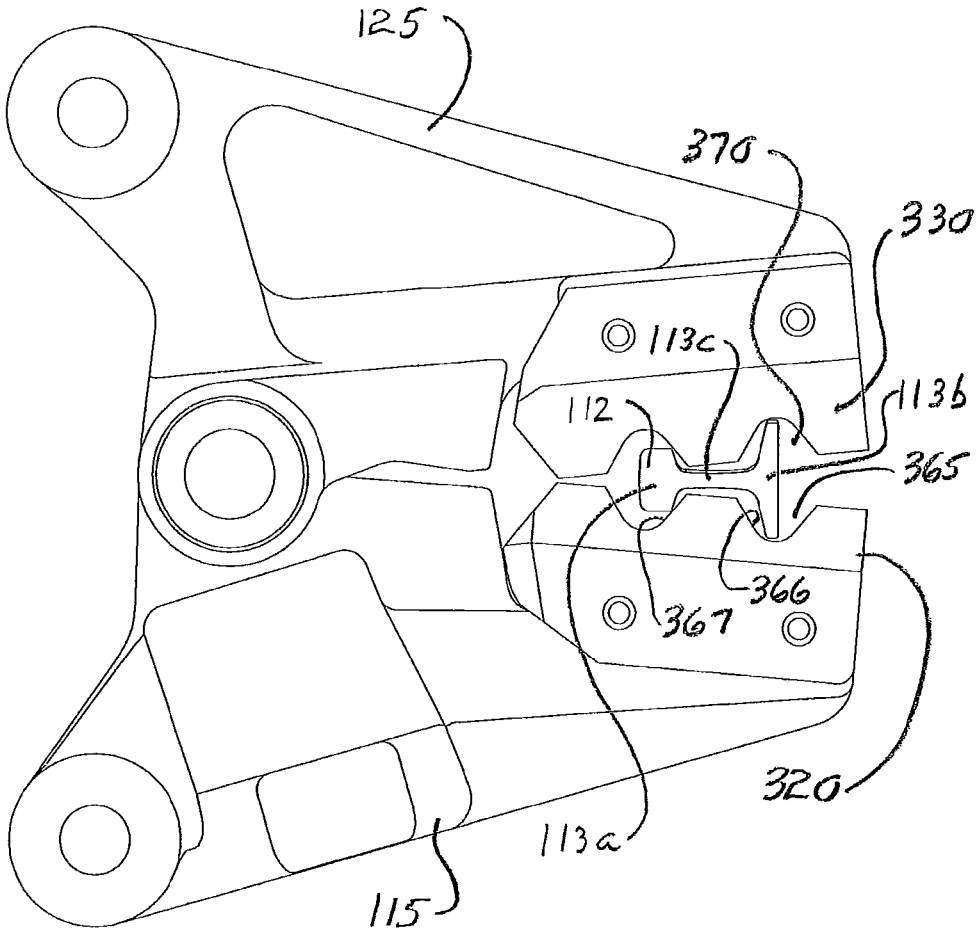
FIG. 13 is a side view similar to that illustrated in FIG. 4, however, utilizing the blade set of the second embodiment of the subject invention.

A second embodiment of the subject invention is directed to an identical jaw set 110 having, however, a bottom blade 320 connected to the bottom jaw 115 and a top blade 330 connected to the top jaw 125 wherein the bottom jaw 115 and the top jaw 125 are identical to those previously discussed herein. However, the bottom blade 320 and the top blade 330 differ from the bottom blade 120 and top blade 130 previously discussed with respect to, for example, FIG. 3. In particular the bottom blade 320 and the top blade 330 are intended not only to sever the railroad rail 112 through the motion off the top blade 330 applying a force to the rail 112 supported by the raised support rail 340, 345, but additionally, as illustrated in FIG. 13, producing a tensile force between the rail head 113 and the rail foot 113*b* utilizing the recesses 365 associated with the bottom blade 320 and the recesses 370 associated with the top blade 330.

The recesses and the planar segments of the bottom blade 320 and the top blade 330, when viewed from the side, are identical and for that reason the bottom blade 320 represented in FIG. 12 will be discussed with the understanding that the side view of the top blade 330 is identical to but inverted from that of the bottom blade 320 illustrated in FIG. 12.

Figure 12:
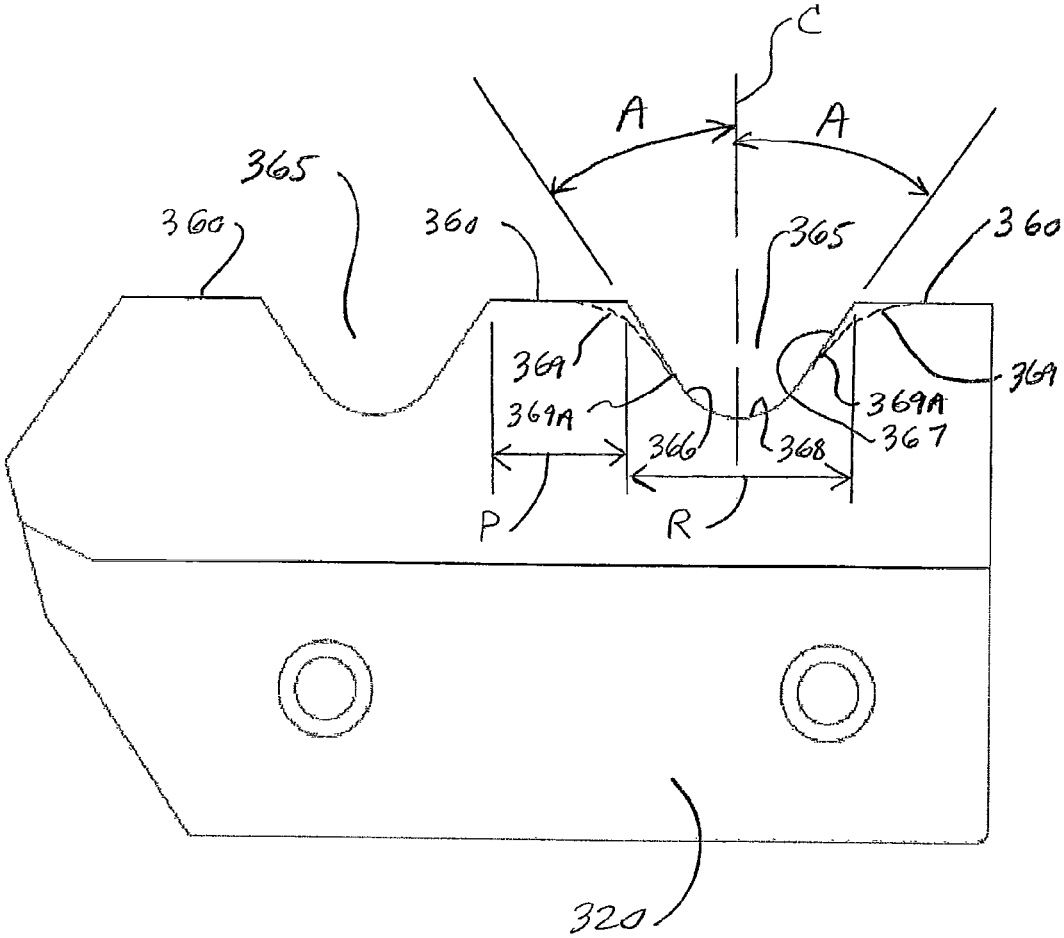
FIG. 12 is a side view of the top blade and the bottom blade illustrated in FIG. 11.

Directing attention to FIG. 12, the bottom blade 320 when viewed from the side, includes recesses 365, wherein each recess has two sides 366, 367 extending about a recess centerline C and away from adjacent planar surface segments 360. The two sides 366, 367 intersect at a radiused segment 368. As illustrated in FIG. 12, the profile of each recess 365 is symmetric about the recess centerline C. Additionally the sides 366, 367 of each recess 365 forms an angle A with the recess centerline C of at least 20 degrees. The angle A may be between 20 degrees and 60 degrees and preferably 35 degrees.

As illustrated in FIG. 12, the sides 366, 367 of the recess 365 are straight and intersect at the radiused segment 368.

In the alternative, and as illustrated by the dashed line 369, the recess sides 366, 367 may be curved and intersect with the radiused segment 368. Under these circumstances, the recessed side angle A' as measured at a tangent 369A at the intersection of the radiused segment 368 and each side 366, 367.

Continuing to direct attention to FIG. 12, each planar surface segment 360 has a length P, wherein the length P is at least 2 inches. Additionally, the ratio of the length R of each recess 365 to the length P of each planar surface segment 360 is between 1 to 3. In a preferred embodiment the ratio is approximately 1.7.

Furthermore, the depth D of each recess 365 is less than the length R of each recess 365. In particular, the ratio of the depth D of each recess with the length R of each recess is between 0.25 and 0.75 and preferable approximately 0.5.

Figure 15:
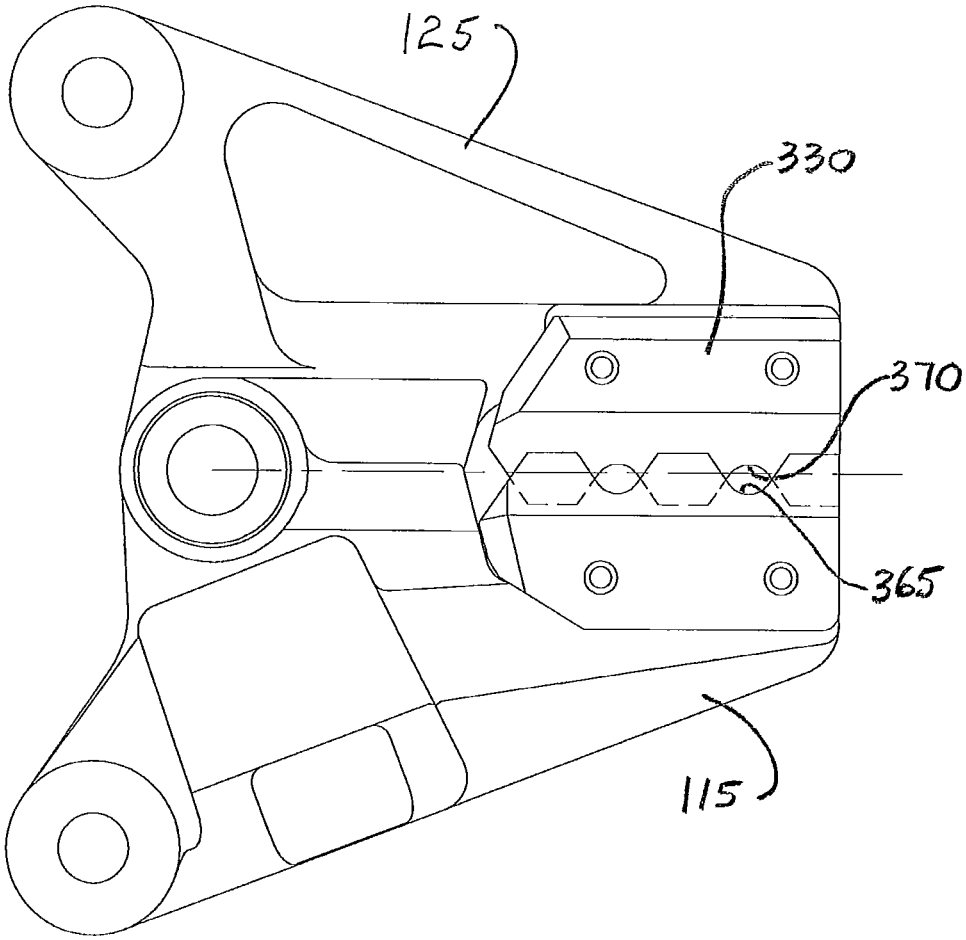
FIG. 15 is a side view similar to that illustrated in FIG. 8, however, utilizing the top and bottom blades in accordance with the second embodiment of the subject invention.

Directing attention to FIG. 15, it should be noted that the recesses 365 of the bottom blade 320 and the recesses 370 of the top blade 320 are aligned with one another when the jaws 115, 125 are in the closed position.

Figure 2:
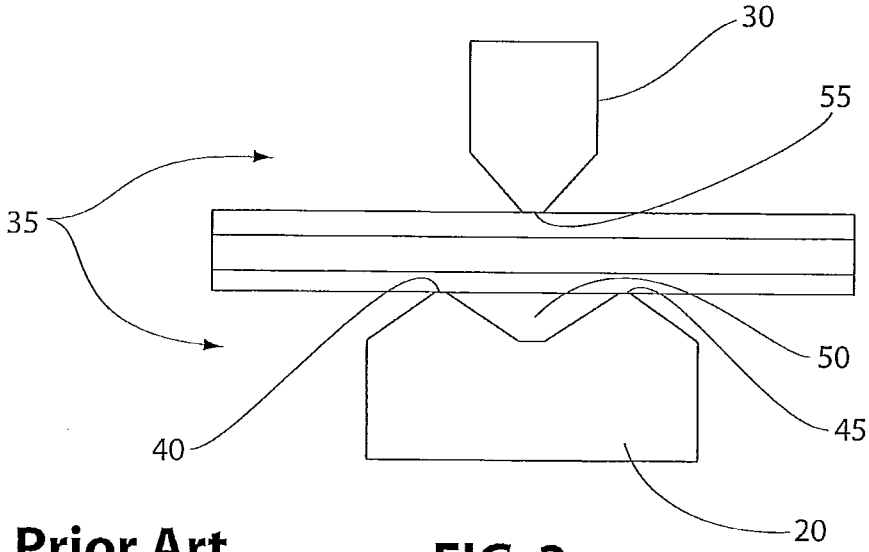
Prior Art FIG. 2
FIG. 2 is prior art and is a view of the jaw set in FIG. 1 along lines "2-2"
Figure 14:
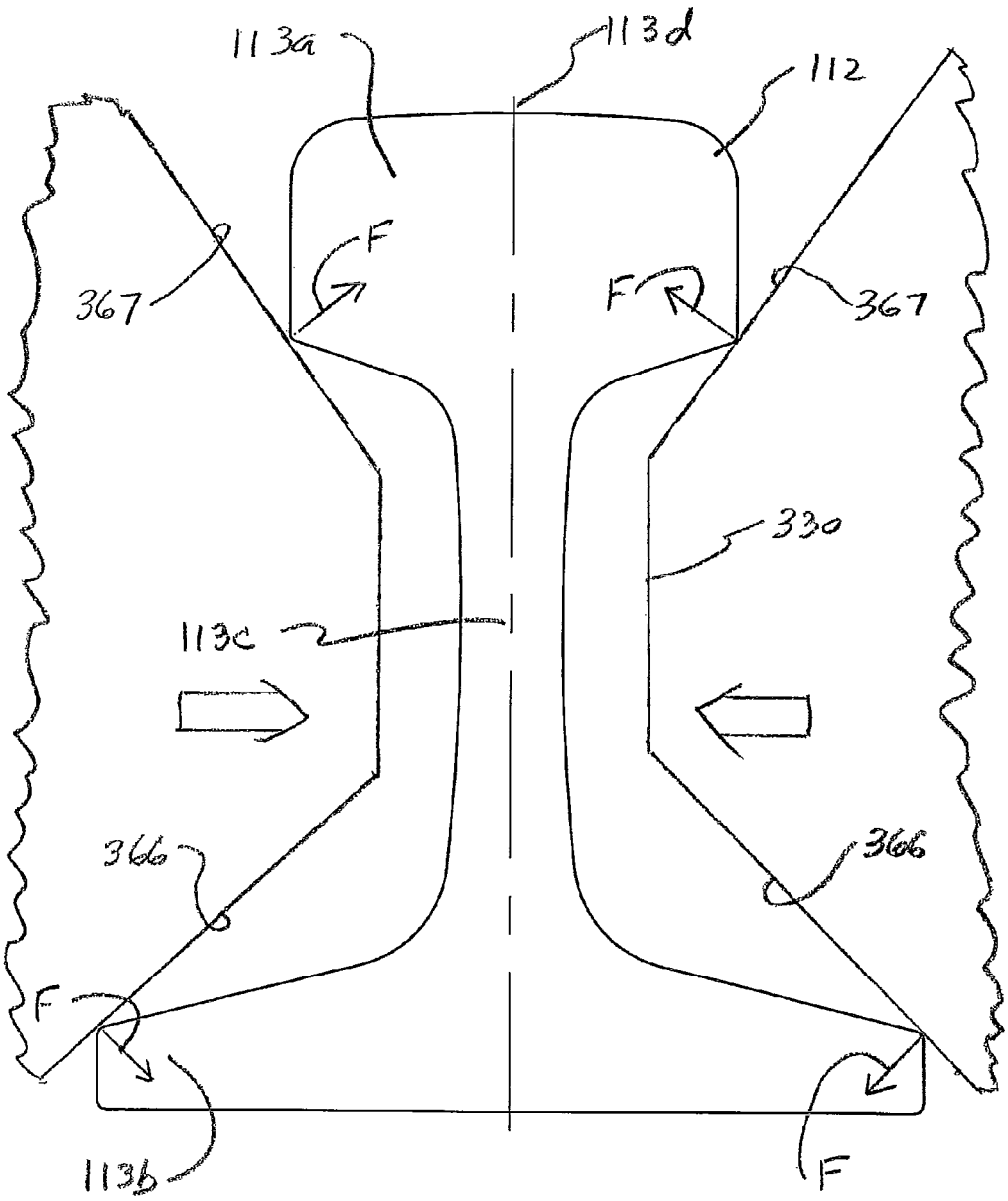
FIG. 14 is a cross-sectional view of the railroad rail typical of that illustrated in FIG. 13.

The rail breaker, as illustrated in the embodiments of FIGS. 3-8, breaks the rail 112 as illustrated in FIG. 2 by essentially applying a central force to the rail which is simply supported of the location where the central force is applied. By doing so, a bending moment imparted to the rail forces the rail to flex and since the rail is brittle, this flexure causes the rail to break. However, the Applicant has realized that a rail that retains the head, foot and web intact during this rail breaking operation is fairly strong if the head or the foot of the rail could be separated before or during the time of the rail breaking, then there would be much less resistance to breaking the rail in the fashion in the fashion illustrated in FIG. 3. To that end the embodiment illustrated in FIGS. 10-13 and 15 show a design intended not only to break the rail by imparting a bending moment, as illustrated in FIG. 2, but furthermore, to further compromise the structural integrity of the rail by separating the head and /or the foot from the web. FIG. 14 illustrates the rail 112 with the head 113*a*, the rail foot 113*b*, and the rail web 113*c* therebetween. In the arrangement illustrated in FIG. 14, the rail is symmetric about the centerline 113*d*. Directing attention to both FIGS. 13 and 14, the sides 366 of one recess 365 engages the foot 113*b* while the side 367 of another recess 365 engages the head 1*q*3*a* of the rail 112. Since the sides are angled, then as the bottom jaw 115 and top jaw 125 close together, the angled surfaces 366, 367 act to pull apart the head 113*a* from the foot 113*b*, thereby imparting tension to the web 113*c*. In the event that only the surfaces only on the bottom blade 320 engage the rail 112 in such a fashion, then the head 113*a* and the foot 113*b* will be rotated relative to one another thereby imparting bending to the web 113*c*. If on the other hand the side 367 of both the bottom blade 320 and top blade 330 engage the head 113*a* and both sides 366 of the bottom blade 320 and the top blade 330 engage the foot 113*b*, then the web 113*c* will be subjected primarily to tension. In either case, the application of the bending force in an axis perpendicular to the centerline of the rail, as seen in FIG. 2, and the separate force imparted between the head 113*a* and the foot 113*b* of the rail 112 will promote failure of the rail 112. FIG. 14 illustrates a simplified version of the mechanism by which the head 113*a* and the foot 113*b* may be separated. Indicated in dashed lines is a profile of the bottom blade 320 and the top blade 330 and these blades 320, 330 move toward one another. The sides 366, 367 move toward one another and apply forces as indicated by F to the head 113 and to the foot 113*b* thereby imparting, as discussed, tensile forces to the web 113*c*. depending upon the manner in which the rail 112 is secured within the bottom blade 320 and the top blade 330, the sides 366, 367 of the bottom blade 320 and top blade 330 may engage the head 113*a* and foot 113*b* with similar forces thereby producing tension within the web 113*c* or, in the alternative, one may have greater contact than the other thereby producing a bending motion between the head 113*a* and the foot 113*b*. Although not to be considered as limiting, the ratings or rails that may be processed utilizing the jaws in accordance with the subject invention may range from a 90 pound rail to a 132 pound rail.

In operation, the trail 112 may be held between the bottom jaw 115 and the top jaw 125 such that the head 113*a* of the rail 112 is secured within one set of recesses 365 while the foot 113*b* is secured with a separate set of recesses 365 wherein the sides 366, 367 of adjacent recesses are engaging the head 113*a* and the foot 113*b*. the bottom jaw 115 and the top jaw 125 are advanced such that the top jaw 125 applies a load on the rail in a fashion similar to that illustrated in FIG. 2 while separately the bottom jaw 115 and top jaw 125 through the bottom blade 320 and top blade 330 apply a tensile force between the head 13*a* and the foot 113*b* urging the foot 113*b* away from the head 113*a* by one or both sides of the web 113*c* until the rail 112 breaks.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A blade set associated with jaws for demolition equipment, wherein at least one jaw rotates relative to the other jaw about a rotational axis within a common rotational plane, the blade set comprising:

a) a bottom blade adapted to be secured to the bottom jaw, wherein the bottom blade has:
  1) a first radial axis therethrough and within the rotational plane;
  2) two opposing raised support rails, each having:
    i) planar surface segments generally perpendicular to the rotational plane and extending parallel to the first radial axis along a length;
    ii) recesses between the planar surface segments along a length, wherein the recesses extend across the width of the support rail and the recesses of one support rail are aligned with corresponding recesses of the other opposing support rail;
  3) a cavity extending between and adjacent to the support rails;

b) a top blade adapted to be secured to the top jaw, wherein the top blade has:
  1) a second radial axis therethrough and within the rotational plane;
  2) a raised knife rail having:
    i) planar surface segments generally perpendicular to the rotational plane and extending parallel to the second radial axis along a length;
    ii) recesses between the planar surface segments along a length, wherein the recesses extend across the width of the knife rail;
    iii) wherein the width of the knife rail at the planar surface segments is less than the width at the opening of the cavity;

c) wherein the top blade and the bottom blade are symmetric about the rotational plane;

d) wherein the ratio of the length of each recess to the planar surface segment length is between 1.0-3.0;

e) wherein when viewed from the side, the recesses in the top blade and in the bottom blade have two sides extending about a recess centerline and extending away from adjacent planar surface segments, wherein the two sides come together and intersect at a radiused segment therebetween;

f) wherein the sides of the recesses form an angle A with the central axis of at least 20 degrees; and g) wherein the raised knife rail closes into the cavity.

2. The blade set according to claim 1, wherein the profile of each recess, when viewed from the side, is symmetric about a recess centerline.

3. The blade set according to claim 1, wherein the angle A may be between 20-60 degrees.

4. The blade set according to claim 3, wherein the angle is 35 degrees.

5. The blade set according to claim 1, wherein the recess sides are straight and intersect at a radiused segment.

6. The blade set according to claim 1, wherein the recess sides are curved and intersect at a radiused valley and wherein the recessed side angle is measured at a tangent at the intersection of the radiused segment and each side.

7. The blade set according to claim 1, wherein each planar surface segment has a width P and wherein the width P is at least 2 inches.

8. The blade set according to claim 1, wherein the ratio is approximately 1.7.

9. The blade set according to claim 1, wherein the depth D of the recess is less than the width R of the recess.

10. The blade set according to claim 9, wherein the ratio of the depth D of the recess to the width R of the recess is between 0.25 and 0.75.

11. The blade set according to claim 10, wherein the ratio of the depth D of the recess to the width R of the recess is approximately 0.5.

12. A jaw set for demolition equipment comprised of:

a) a bottom jaw pivotally connected to a top jaw;

b) a bottom blade adapted to be secured to the bottom jaw, wherein the bottom blade has:
  1) a first radial axis therethrough and within the rotational plane;
  2) two opposing raised support rails, each having:
    i) planar surface segments generally perpendicular to the rotational plane and extending parallel to the first radial axis along a length;
    ii) recesses between the planar surface segments along a length, wherein the recesses extend across the width of the support rail and the recesses of one support rail are aligned with corresponding recesses of the other opposing support rail;
  3) a cavity extending between and adjacent to the support rails;

c) a top blade adapted to be secured to the top jaw, wherein the top blade has:
  1) a second radial axis therethrough and within the rotational plane;
  2) a raised knife rail having:
    i) planar surface segments generally perpendicular to the rotational plane and extending parallel to the second radial axis along a length;
    ii) recesses between the planar surface segments along a length, wherein the recesses extend across the width of the knife rail;
    iii) wherein the width of the knife rail at the planar surface segments is less than the width at the opening of the cavity;

d) wherein the top blade and the bottom blade are symmetric about the rotational plane;

e) wherein the recesses in the top blade and the bottom blade are aligned with one another when the jaws are in the closed position;

f) wherein when viewed from the side, the recesses in the top blade and in the bottom blade have two sides extending about a recess centerline and extending away from adjacent planar surface segments, wherein the two sides come together and intersect at a radiused segment therebetween;

g) wherein the sides of the recesses form an angle A with the central axis of at least 20 degrees; and h) wherein the raised knife rail closes into the cavity.

13. The jaw set according to claim 12, further including a railroad rail having a foot and a head with a web therebetween along a rail axis, wherein at least one recess engages the web of the rail opposite the head or the foot along the side of the recess such that when the jaws close, the rail is subjected to tension along one or both sides of the web about the rail axis.

14. The jaw set according to claim 13, wherein recesses engage both the webs adjacent the both the head and the foot.

15. The blade set according to claim 13, wherein the rails range in size from 90 lb. to 132 lb.

16. A method of processing a railroad rail using a rail breaker demolition tool having a jaw set with a bottom jaw with a bottom blade and a top jaw with a top blade, wherein the blades have planar surfaces and recesses and wherein the bottom blade has support rails with planar surfaces and spaced apart by a cavity and the top blade has a knife rail with a planar surface, wherein when viewed from the side, the recesses in the top blade and in the bottom blade have two sides extending about a recess centerline and extending away from adjacent planar surface segments, wherein the two sides come together and intersect at a radiused segment therebetween, wherein the sides form an angle A of at least 20 degrees with the central axis, wherein the width of the knife rail increases linearly away from the planar surface and wherein recesses in the top blade and the bottom blade are generally aligned with one another when the blades are in a closed position, wherein the raised knife rail closes into the cavity, and wherein the recesses have outwardly tapering sides extending from valleys within each recess and wherein the railroad rails have a head and a foot with a web therebetween, the method comprising the steps of:

a) holding the rail between the jaws such that the bottom blade provides spaced apart support to the rail and such that the web opposite to the head or the foot is engaged by one of the sides of the recess; and b) advancing one or both of the top jaw and bottom jaw together such that the top jaw applies a load on the rail midway between the spaced apart support of the bottom blade to provide a bending force to the rail about an axis perpendicular to the rail longitudinal axis and furthermore such that the jaw applies a tensile force between the head and the foot urging the foot away from the head on one or both sides of the web until the rail breaks and a severed portion is ejected from the jaws.

17. The method according to claim 16, wherein the recesses engage the web adjacent to one or both of the head and the foot such that there is tension between the parts.

* * * * *

UNITED STATES PATENT AND TRADEMARK OFFICE

CERTIFICATE OF CORRECTION

PATENT NO. : 8,628,035 B2
APPLICATION NO. : 13/387806
DATED : January 14, 2014
INVENTOR(S) : John R. Ramun It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 54 days.

Signed and Sealed this
Twenty-second Day of September, 2015

Michelle K. Lee

Michelle K. Lee
*Director of the United States Patent and Trademark Office*